United States Patent [19]

Unger

[11] 4,043,745

[45] Aug. 23, 1977

[54] APPARATUS AND PROCESS FOR THE DRYING OF WET, LOOSE MATERIAL, IN PARTICULAR, COKE POWER OR FINES

[76] Inventor: Günther Unger, 186, Velberterstrasse, Heiligenhaus, Germany, 5628

[21] Appl. No.: 655,515

[22] Filed: Feb. 5, 1976

[30] Foreign Application Priority Data

Sept. 25, 1975 Germany ..... 2542670

[51] Int. Cl.[2] ..... F27B 7/30; F27B 7/32

[52] U.S. Cl. ..... 432/13; 432/112; 432/113; 432/114; 432/118

[58] Field of Search ..... 432/13, 14, 112, 114, 432/113, 118

[56] References Cited

U.S. PATENT DOCUMENTS

| | | | |
|---|---|---|---|
| 1,594,046 | 7/1926 | Carr | 432/114 |
| 1,810,476 | 6/1931 | Harty et al. | 432/114 |
| 1,964,344 | 6/1934 | Fasting | 432/118 |
| 2,697,068 | 12/1954 | Poindexter et al. | 432/112 |
| 3,709,474 | 1/1973 | Kamstrup-Larsen | 432/13 |

*Primary Examiner*—John J. Camby

*Attorney, Agent, or Firm*—Andrus, Sceales, Starke & Sawall

[57] ABSTRACT

A process and apparatus for the drying of coke fines without the generation of noxious quantities of dust by means of a burner flame and associated flue gases extending along an axis. The wet loose material is moved along the axis toward the burner and rotated to expose it to the flue gases for predrying the material. The major quantity of moisture is removed during the predrying and entrained in the discharged flue gases. The moisture level of the predried material is maintained sufficiently high to prevent dust generation. Thereafter, the movement and rotation of the predried material is continued in an enclosed space heated by the flame and gases, to complete the drying of the material with little or no dust generation.

21 Claims, 5 Drawing Figures

APPARATUS AND PROCESS FOR THE DRYING OF WET, LOOSE MATERIAL, IN PARTICULAR, COKE POWER OR FINES

FIELD OF THE INVENTION

The present invention is directed to an apparatus and process for the drying of wet loose material, in particular coke powder or fines.

BACKGROUND OF THE INVENTION

The present invention is directed to a process for the drying of wet loose material, in particular coke powder or fines, with the help of a heat source such as a burner and its flue gases. According to the invention, the material rotates about an axis aligned with the burner flame and the stream of the flue gases and travels along the axis so as to begin its rotation and movement in an opposing direction to the flue gas. The material is subjected to predrying. The vapor produced by predrying moisture out of the material is entrained in the flue gases. Subsequently the material is further dried to a terminal moisture level. The invention is also directed to apparatus for carrying out this process.

An example of loose material which can be dried in accordance with the invention is salt or sand but preferably mineral fuels, such as coal having a fluid consistency and above all, coke fines. Without exception, these materials set free considerable amounts of dust as soon as they have been deprived of a predetermined amount of moisture. Particularly large amounts of dust develop, as is known from experience, with the drying of coke fines. Because of the properties of coke fines, this dust is particularly undesirable and results in considerable pollution of the environment when placed in the atmosphere.

The existence of a process of the type described above is known and is carried out with apparatus having a wet material inlet, a drying outlet, and a rotatable inner drum which incorporates a heat source and/or hot gases. On an end of the drum, wall perforations are provided for the discharge of the material. A casing is provided which is arranged concentrically to the inner drum and which provides on the drum end, a removal pipe which opens into the space between the drum and the casing.

According to the known process the wet material is predried in the front part of the inner drum through the direct action of the flue gases of the burner. Consequently, the vapor originating by the predrying of the moisture out of the material becomes entrained in the flue gases.

In an attached section of the inner drum adjacent to the burner, the material is then further dried. The vapor produced by this drying likewise becomes entrained in the flue gases. The corresponding gas mixture formed out of the flue gas and the vapor is conveyed out of the inner drum in the space between the drum and the casing to communicate the waste heat on the wall on the inner drum.

With the foregoing process, it is technically necessary to employ dust collection equipment because of the considerable quantity of dust which is set free as soon as the material reaches its terminal moisture. This dust passes initially in the flue gas-water vapor mixture and arrives at the outlet of the gas stream. On the basis of emission protection, dust collection equipment cannot be done without. The dust development by the rotation and movement of the material dried down to its end moisture within the entire process cannot be avoided. There results, before long, disadvantages.

The process is encumbered with the dust collection equipment which causes considerable technical and economic expense. Additionally, the dust contained in the vapor causes difficulty within the process and accumulates in a form which, as a rule, excludes further direct mechanical treatment.

SUMMARY OF THE PRESENT INVENTION

The present invention resides in an alteration of the previously known process and in the apparatus for carrying it out. It is an object of the present invention that the dust may be discharged out of the process without requiring dust collection apparatus and that the difficulties resulting from the dust may be done away with.

According to the present invention this purpose is obtained in that the vapor moisture of the predrying and the flue gas is separated and carried off before the subsequent drying of the material, that the material during its subsequent drying is maintained contained with respect to the burner flame and its flue gas and that the vapors originating by the subsequent drying of the material, separated from the flue gas at the beginning of the movement of the material in the subsequent drying step, are discharged.

The process arises from the realization that the dust development first occurs when the predrying is ended. This predrying is, therefore, induced, according to the invention, preferably down to the residual moisture with the assurance that no dust development will arise. This limit lies, in general, at about 10–12% moisture of the material. Consequently, the flue gases, along with the vapor are dust free. The vapors comprise the main quantity of the driven off moisture, because as a rule, the greater quantity of the total moisture is extracted from the material during predrying. Consequently, the flue gases and the contained moisture can be further handled without dust separation. This permits either direct emission or provision to condensation equipment and the recovery of the considerable quantity of heat. This allows the prewarming of the wet material to be treated whereby the thermal efficiency of the process is improved and the economy correspondingly increases.

The flue gases further contain no dust because they are maintained contained from the dust producing further-to-be-dried material before their entrance in the predrier. The main or further drying does not directly employ the flue gases and burner flames. The vapor produced by the further drying likewise contains no dust until a predetermined residual moisture. Therefore, the process according to the invention is so carried out in its exemplary embodiment that the material may be dried down to a residual moisture with the certainty that no dust will correspondingly arise. This lies at approximately 2% moisture or above. Thereupon, the moisture produced by the further drying is delivered without dust collection.

If it is necessary that the material must be dried to a very low residual moisture, the dust may become entrained in small amounts in the moisture originating by the terminal drying. This dust can be precipitated easily through the condensation of the moisture so that the use of dust collection apparatus is unnecessary.

At the end of the process, the remaining dust developed by the discharge of the material dried down to its end point occurs under separation from the flue gases and the main portion of the vapor. Through the use of suitable conveying means within the process which is operatively associated with the material dried down to its residual moisture condition, the entrainment of this main dust quantity in the vapor produced upon the further drying of the material can be lessened or prevented.

The process according to the invention has the advantages that it can be carried out independently of the residual moisture of the dried material without the expense of associated dust separation apparatus because the dust resulting upon the end of the process is separated from the discharge gas and is discharged along with the material. The dust occurs therefore in a form in which the material at its residual moisture can be processed without difficulty.

Further, the invention has the advantage that it permits heating of materials subject to thermal degradation such as coal, for example, coking coal, without heat damage occurring. One can, therefore, according to the invention, preheat coking coal to a temperature which lies below the coking range, for example 300° C, and thereby shorten the coking time in the coking oven.

In general a material of silt like consistency sensitive to heat damage, for example, bituminous coal pond silt cannot be indirectly dried because, on account of its adhesive consistency, it adheres on the hot walls. This circumstance might also preclude treatment of such silt or sediment in the inventive process. However, according to the invention this is nevertheless possible since the vapor of the predrying and the flue gases before the further drying of the material is separated and discharged. The material during its further drying is maintained contained with respect to the burner flame and its flue gases and the vapor originating by the further drying of the material is separated from the flue gas during the movement of the material in the further drying and is discharged.

BRIEF DESCRIPTION OF THE DRAWING

The details, further features, and other advantages of the invention will be apparent from the following description of exemplary embodiments of the novel process and apparatus, taken in conjunction with the Figures of the drawing.

DETAILED DESCRIPTION OF THE PREFERRED EMBODIMENT

Figures 1, 1A, 2, 3:
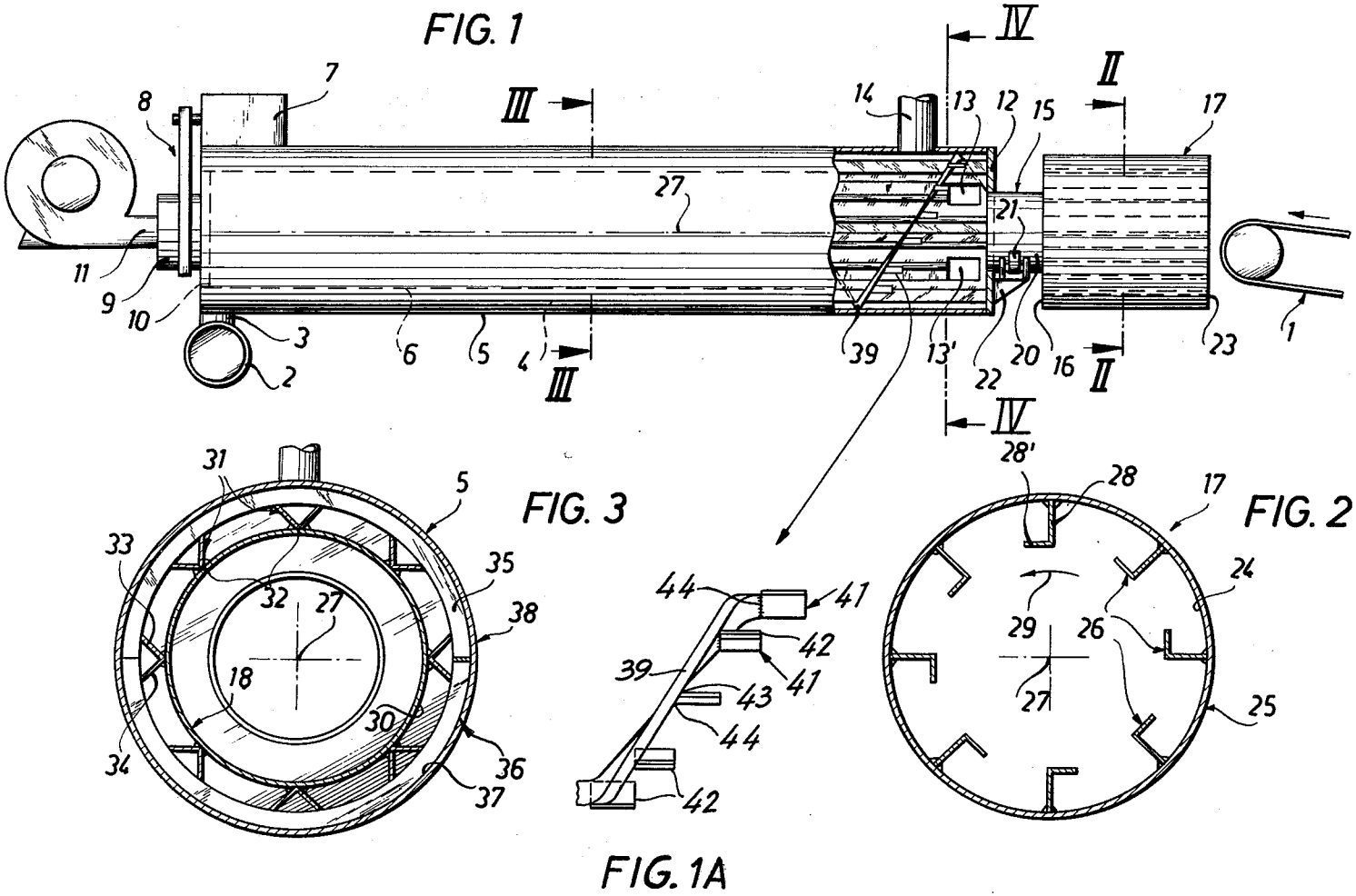
FIG. 1 shows, in general form, apparatus suitable for carrying out the invention, said Figure being a partially broken away side view.
FIG. 1*a* is a partial perspective view of an element of the apparatus shown in FIG. 1.
FIG. 2 is a sectional view taken along the line II—II of FIG. 1.
FIG. 3 is a sectional view taken along the line III—III of FIG. 1.
Figure 4:
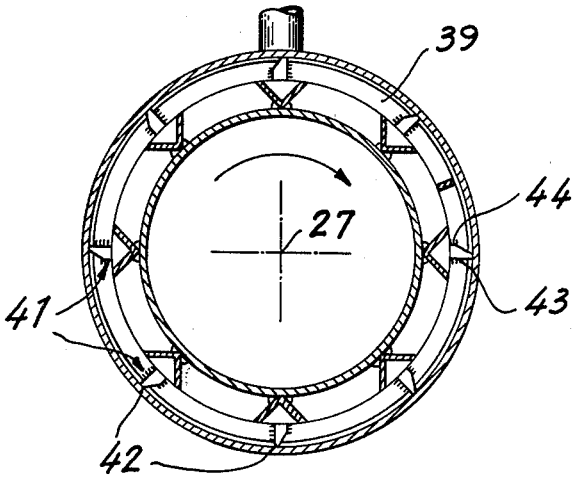
FIG. 4 is a sectional view taken along the line IV—IV of FIG. 1.

The apparatus shown in the Figures is suitable for the drying of coke fines. The wet material to be dried is supplied to the apparatus by means of continuous conveyor 1. The dried material is removed from the apparatus in a completely enclosed housing 2. Housing 2 is connected by means of pipe support 3 to the space 4 between inner drum 6 and a concentrically arranged casing 5. Drum 6 is driven by means of motor 7 and drive 8. Inner drum 6 accommodates a connecting pipe 9 by which burner 11 is inserted in end 10 of inner drum 6. Burner 11 is, preferably, petroleum fired. The other end of the inner drum 6 is identified with the numeral 12. Adjacent end 12, the wall of inner drum 6 is provided with a plurality of perforations 13, 13'.

Additionally, end 12, contains a discharge pipe 14 which opens into space 4 in which the main or subsequent drying occurs. Pipe 14 serves to remove the vapors which originate from the further drying.

An intermediate pipe 15 is attached to the end 16 of predrying drum 17. The section 20 of intermediate pipe 15 located between the opposing ends 12 and 16 of inner drum 6 and predrying drum 17, respectively, serves to journal the drum system. This journal may be provided by several rollers 21 which are journalled in stationary supports 22.

Continuous conveyor 1 provides the wet, supply material into end 23 of predrying drum 17 which rotates together with inner drum 6. On the inner side 24 of casing 25 of predrying drum 17 are located elements 26. Elements 26 receive and transport the wet material along the flue gas stream of burner 11 which travels along the longitudinal axis of the drum system. In the herein disclosed exemplary embodiment of the invention, elements 26 are generally similar. Each are formed with an angle profile having arm 28 fastened to drum casing 25, as by welding. The other arm 28' initially raises the wet material and delivers it in the flue gas stream with the further movement of predrying drum 17 in the direction of arrow 29. As a result of the delivery of the material lateral to the gas stream, the wet delivery material travels in the progress of its drying in a direction from input end 23 to opposite lying end 16 of predrying drum 17. The predried material is delivered to intermediate pipe 15 and enters into space 4 through the perforations 13, 13' provided in the wall of inner drum 6. The structure of this space is apparent from FIG. 3.

Angled profiles 31 are affixed to the outer surface 30 of inner drum 6, as, for example, by welding the apexes of the angle profiles to the outer surface 30 of the inner drum. Angle profiles 31 extend axially so as to be parallel to axis 27 of the drum system. The plurality of angled profiles may be arranged radially opposite about inner drum 6.

The pair of arms 33 and 34 of each angle profile 31 serve to fasten a ribbon helix having its outer edge 36 coacting with the inner surface 37 of casing 5.

The material coming out of predrier 17 and further dried in space 4 is transported upward by the above described angle profiles 31 during drum movement. Angle profile 31 prevent, with further rotation of the drum, the material from slipping off during downward movement. Hence, there results, during the entire rotation, a contact of the material with the inner drum 6 which is heated by the flame of burner 11 and its flue gases. Further, there results a forward movement of the material through the operation of helical band 35 so that the material is eventually discharged through connector 3 into housing 2. The conveyor 39 formed by helical band 35 is, itself, closed. Consequently, little or none of the dust amounts appearing by the discharge of the further dried material can be entrained in moisture obtained by the further drying of the material. This moisture is discharged in pipe 14.

The equipment for the utilization of waste heat, for example, condensing the vapor emerging out of predrier 17 for the material is not shown in the drawing.

For the processing of adhesive material, for example, silt or sediment, the helical band has a plurality of scrappers 41 on one side. These scrapers are flat, iron sections of which the leading edges scrape the slime off the inner wall of casing 5. It will be appreciated that without scrapers 41, the material being dried might adhere between the helical band and casing 5 and block the operation of the apparatus. The use of scrapers 41 serves to prevent this malfunction.

The scrapers 41 have a cutter 42 on their forward edge and are welded to the helical band at 43 and 44. They are so arranged that their paths on the inner surface of the casing overlap without interstices. A direct contact of the blade cutters with the casing is not absolutely necessary.

Coking coal or generator coal can be preheated to a temperature which reduces the coking time before it reaches discharge end 3.

Various modes of carrying out the invention are contemplated as being within the scope of the following claims particularly pointing out and distinctly claiming the subject matter which is regarded as the invention.

I claim:

1. A process for the drying of wet, pulverulent material while avoiding the generation of air borne dust by means of a burner providing a flame and flue gases extending along an axis, said method comprising the steps of:

moving the wet, pulverulent material along the axis from a point spaced from said burner toward said burner while rotating the material about an axis aligned with the axis of the flame and gases for exposing the materials to the gases for predrying the material down to a predetermined moisture level at or above which dust generation does not occur, said movement and rotation entraining the removed moisture in discharged gases; thereafter continuing the movement and rotation of the predried material along the axis while placing the material in closed heat transfer relationship with respect to the flame and gases to further dry the material to a terminal moisture level below the predetermined moisture level; and discharging the moisture produced by the further drying of the material.

2. The process according to claim 1 characterized in that the material is predried to a moisture level of approximately 10–12%.

3. The process according to claim 2 characterized in that the material is further dried to a residual moisture level of approximately 2% and the moisture produced out of the further drying is discharged without dust.

4. The process according to claim 2, characterized in that the material is further dried to a moisture level of under 2% and any attendant dust is separated from the moisture produced by the further drying.

5. The process according to claim 4, wherein the separation of the dust and moisture is obtained by condensing the moisture for the precipitation of the dust.

6. The process according to claim 1 characterized as a process of drying carbonaceous material.

7. The process according to claim 1 characterized as a process of drying coke fines.

8. The process according to claim 1 characterized in that the material is predried to a moisture level of approximately 10–12%.

9. The process according to claim 1 characterized in that the material is further dried to a residual moisture level of approximately 2% and the moisture produced out of the further drying is discharged without dust.

10. The process according to claim 1 characterized in that the material is further dried to a moisture level of under 2% and any attendant dust is separated from the moisture produced by the further drying.

11. The process according to claim 6 characterized in that coking coal is heated for drying at a temperature below the degasing temperature thereby to shorten the coking time.

12. The process according to claim 6 characterized in that generator coal is heated for drying at a temperature below the degasing temperature.

13. The process according to claim 1 characterized as a process of drying an initially slime like material.

14. The process according to claim 1 characterized in that the wet supply material is preheated with heat obtained by condensing the vapor from the discharged flue gases.

15. Apparatus for the predrying of wet, pulverulent material, while avoiding the generation of air borne dust, comprising:

a burner (11) providing a flame and flue gases extending along an axis;

a predrying drum (17) spacedly positioned from said burner and rotatable about said axis, said predrying drum receiving the wet, pulverulent material for exposing same to said gases;

an inner drum (6) having one end (12) coupled to said predrying drum and the other end (10) coupled to said burner for receiving the burner flame and flue gases, said drum being rotatable about the axis;

a means for rotating said predrying and inner drums;

a casing spacedly, concentrically surrounding said inner drum for forming a chamber (4) closed with respect to said burner at the end adjacent said burner;

said inner drum receiving predried material from said predrying drum and having perforations (13, 13') in the drum wall adjacent said one end communicating with the chamber (4) between said drum and casing for supplying the predried material into said chamber;

a vapor discharge means (14) communicating with said chamber adjacent said one end of said drum; and a dried material discharge means (2, 3) communicating with said chamber adjacent the other end of said drum.

16. The apparatus according to claim 15 wherein said predrying drum includes means for moving the material axially along the drum and the outer surface of said inner drum includes means for moving said predried material axially through said chamber.

17. The apparatus according to claim 15 characterized in that an intermediate pipe is provided between said one end of said inner drum and the opposing end of said predrying drum.

18. The apparatus according to claim 17 characterized in that the section of said intermediate pipe lying between the opposing ends of the said predrying drum and said inner drum journals said drums.

19. The apparatus according to claim 16 characterized in that axially extending angled profiles are mounted on the outer surface of said inner drum for the transport of the predried material and for the supression of its movement upon the outer surface of inner drum wall and that a band formed helix is fastened to the angled profiles for surrounding said inner drum and for moving said predried material axially through said chamber.

20. The apparatus according to claim 19 characterized in that scrapers are provided on the helix contiguous with the casing.

21. The apparatus according to claim 20 characterized in that the scrapers contain cutters which are so arranged that their paths on the casing overlap without interstices.

* * * * *